US008038508B2

(12) United States Patent
Lim et al.

(10) Patent No.: US 8,038,508 B2
(45) Date of Patent: Oct. 18, 2011

(54) APPARATUS FOR POLISHING A WAFER AND METHOD FOR DETECTING A POLISHING END POINT BY THE SAME

(75) Inventors: Jong-Heun Lim, Seoul (KR); Sung-Ho Shin, Yongin-si (KR); Bo-Un Yoon, Seoul (KR); Chang-Ki Hong, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 332 days.

(21) Appl. No.: 12/285,852

(22) Filed: Oct. 15, 2008

(65) Prior Publication Data

US 2009/0098804 A1 Apr. 16, 2009

(30) Foreign Application Priority Data

Oct. 15, 2007 (KR) ..... 10-2007-0103367

(51) Int. Cl.
*B24B 49/00* (2006.01)

(52) U.S. Cl. ..... 451/6; 451/10; 451/11; 451/44; 451/59; 451/303; 451/307

(58) Field of Classification Search ..... 451/4, 5, 451/6, 8, 9, 10, 11, 41, 44, 59, 299, 303, 451/307
See application file for complete search history.

(56) References Cited

U.S. PATENT DOCUMENTS

| | | | | |
|---|---|---|---|---|
| 6,342,166 | B1 | 1/2002 | Ide et al. | |
| 7,066,787 | B2 * | 6/2006 | Nakanishi et al. | 451/6 |
| 7,682,225 | B2 * | 3/2010 | Hongo et al. | 451/303 |
| 2004/0023606 | A1 | 2/2004 | Wang et al. | |
| 2004/0185751 | A1 * | 9/2004 | Nakanishi et al. | 451/5 |
| 2006/0019417 | A1 | 1/2006 | Shigeta et al. | |
| 2010/0022166 | A1 * | 1/2010 | Kimba et al. | 451/5 |
| 2010/0105290 | A1 * | 4/2010 | Sakata et al. | 451/6 |

FOREIGN PATENT DOCUMENTS

| | | | |
|---|---|---|---|
| JP | 2004-241434 | A | 8/2004 |
| KR | 10-2000-0048040 | A | 7/2000 |
| KR | 10-2006-0046744 | A | 5/2006 |

* cited by examiner

*Primary Examiner* — Eileen P. Morgan
(74) *Attorney, Agent, or Firm* — Lee & Morse, P.C.

(57) ABSTRACT

A wafer polishing apparatus includes a polishing tape extending between two guide rollers, a first surface of the polishing tape contacting a surface of a wafer to be polished, a polishing head including a pusher pad, the pusher pad adapted to push the polishing tape against the surface of the wafer to be polished, a color image sensor adjacent to the polishing tape, the color image sensor being adapted to detect a color image of the polishing tape and to output a signal corresponding to the detected color image, and a controller connected to the color image sensor, the controller being adapted to receive the signal output from the color image sensor and to determine when a color of the color image detected by the color image sensor changes, a change in the color image indicating a polishing end point.

17 Claims, 7 Drawing Sheets
(2 of 7 Drawing Sheet(s) Filed in Color)

APPARATUS FOR POLISHING A WAFER AND METHOD FOR DETECTING A POLISHING END POINT BY THE SAME

BACKGROUND

1. Field

Example embodiments relate to an apparatus and method of processing a substrate. More particularly, example embodiments related to an apparatus for polishing a wafer and to a method of determining an end point of a polishing process by the same.

2. Description of the Related Art

An electronic system may include an integrated circuit chip on a printed circuit board, e.g., a controller such as a microprocessor, a memory chip such as a DRAM or flash memory, and so forth. To facilitate mass production, an integrated circuit chip may be formed on a semiconductor wafer.

Conventional formation of an integrated circuit chip on a semiconductor wafer may include selectively removing a portion of the semiconductor wafer, e.g., etching, polishing, and so forth. For example, conventional etching may include positioning the semiconductor wafer between bottom and top electrodes, followed by application of radio frequency (RF) voltage to the top/bottom electrodes to generate plasma for etching a portion of the semiconductor wafer or an object placed on the semiconductor wafer. In another example, conventional polishing may include a sponge roller contacting a semiconductor wafer, e.g., a beveled part or an edge part of the semiconductor wafer, and a solution supplied, e.g., via a nozzle, onto the semiconductor wafer.

Selective removal of portions of a semiconductor wafer may be followed by cleaning. For example, conventional etching, e.g., a reactive ion etching (RIE), may cause surface roughness on the semiconductor wafer, e.g., protrusions on edges of the semiconductor wafer. That is, by-products generated during the RIE may adhere to the semiconductor wafer, e.g., to an edge of the semiconductor wafer, so acicular protrusions may be formed thereon. Such protrusions may function as etch masks, e.g., interfering with proper etching, or may break to trigger generation of particles and impurities on the semiconductor wafer, thereby reducing production yield. Such protrusions may be removed by the cleaning process, e.g., secondary dry etching and/or polishing, before further processing, e.g., a photolithography process.

A conventional dry etching, however, may have an insufficiently precise detection of start/end points of the etching. For example, a conventional detection of start/end points of an etching process may include using an emission spectroscopy analysis, so an end point of the etching process may be determined according to concentration of an activated species easily observable, e.g., energy, ions, and so forth. For example, when an etching gas is used in the etching process, emission spectroscopy analysis may be used to measure concentration of a decomposed material or of reaction formation material of an etching gas in order to determine an end point of the etching process. The concentration may be determined according to variation in emission intensity based on a predetermined wavelength. For example, when using a CF gas, e.g., $CF_4$ gas, to etch a silicon oxide layer, a wavelength of about 483.5 nm may be used to detect emission of a reaction product CO* during etching, so an etching end point may be determined by variation of emission intensity of the CO*. Similarly, when using a CF gas, e.g., $CF_4$ gas, to etch a silicon nitride layer, a wavelength of about 674 nm may be used to detect emission of a reaction product N* during etching, so an etching end point may be determined by variation of emission intensity of the N*. Detection of an end point of an etching process via an emission spectroscopy analysis, however, may be difficult to conduct in real time without over-etching, thereby causing damage to underlying layers.

Another conventional detection of start/end points of an etching process may include using an end point detector (EPD) employing an emission spectroscope with a refraction lattice drivable by a motor. For example, when light generated in a plasma chamber is incident on the refraction lattice, e.g., through an optical fiber, the refraction lattice may divide the received light according to wavelengths to facilitate detection of a wavelength related to the undergoing process for measuring intensity thereof. Use of the EPD, however, may have several shortcomings.

First, in order to determine the wavelength related to the undergoing process, the EPD may require adjustment of a light reception angle of the refraction lattice and detection of light in the spectrum of about 200 nm to about 800 nm, so driving the refraction lattice may require a long time. Second, when intensity of a single wavelength over time is used to determine an end point of an etching process, it may be difficult to determine an end point of etching in small areas due to noise. For example, if a semiconductor wafer is mostly covered with a photoresist layer and only a very small portion thereof to be etched includes, e.g., silicon oxide, wavelengths corresponding to by-products due to the photoresist may be measured as a noise signal. As such, when an area of, e.g., silicon oxide, is small, e.g., about 0.5% of the semiconductor wafer or smaller, most measure signals corresponding to the silicon oxide may be buried in noise, and thus, may have a difficulty to be detected. Third, a change of light intensity may occur in response to causes other than type of an etched layer, e.g., a change in plasma density or a muddy EPD window, thereby causing inaccurate detection. Even if an additional wavelength is used to improve detection sensitivity of the EPD, a real time analysis may be difficult since the wavelength must be changed in the measurement of the existing single refraction lattice method.

A conventional polishing process may include polishing using a polishing tape. The conventional polishing tape may contact the semiconductor wafer during rotation thereof to remove surface roughness from the semiconductor wafer, and may continue polishing the wafer until an end point of the polishing is determined with respect to thickness of the wafer or with respect to a change in tension of the polishing tape contacting the semiconductor wafer. The conventional methods of determining an end point of the polishing, however, may not be sufficiently precise and/or efficient in real time.

SUMMARY

Embodiments are therefore directed to an apparatus and method of processing a substrate, which substantially overcome one or more of the disadvantages of the related art.

It is therefore a feature of an embodiment to provide a wafer polishing apparatus capable of precisely detecting in real time a polishing end point.

It is another feature of an embodiment to provide a wafer polishing apparatus having an enhanced detection sensitivity of a polishing end point.

It is still another feature of an embodiment to provide a wafer polishing apparatus having reduced logical operation processing work in detecting a polishing end point.

It is yet another feature of an embodiment to provide a method of detecting a polishing end point of a wafer using an apparatus with one or more of the above features.

At least one of the above and other features and advantages of the present invention may be realized by providing a wafer polishing apparatus, including a polishing tape extending between two guide rollers, a first surface of the polishing tape contacting a surface of a wafer to be polished, a polishing head including a pusher pad, the pusher pad adapted to push the polishing tape against the surface of the wafer to be polished, a color image sensor adjacent to the polishing tape, the color image sensor being adapted to detect a color image of the polishing tape and to output a signal corresponding to the detected color image, and a controller connected to the color image sensor, the controller being adapted to receive the signal output from the color image sensor and to determine when a color of the color image detected by the color image sensor changes, a change in the color image indicating a polishing end point.

The polishing tape may exhibit a penetration capability of color image. The polishing tape may be substantially transparent. The polishing tape may include one or more of diamond, silicon carbide, silica, ceria, and alumina. The color image may be on a second surface of the polishing tape, the second surface of the polishing tape being opposite the first surface of the polishing tape. The color image sensor may be adapted to generate a color image of a stain formed on the polishing tape, the stain corresponding to a color of the surface of the wafer to be polished. The surface of the wafer to be polished may be a bevel area of the wafer. The surface of the wafer to be polished may be a peripheral portion of the wafer. The peripheral portion of the wafer may include at least one of an edge area of the wafer, a bevel area of the wafer, and a notch area of the wafer. The controller may be adapted to output a stop signal to stop a polishing of the wafer when the polishing end point is determined. The stop signal may include a visual signal and/or an auditory signal.

At least one of the above and other features and advantages of the present invention may be realized by providing a method of detecting a polishing end point in a wafer polishing apparatus having a polishing tape between two rollers and a polishing head including a pusher pad adapted to push the polishing tape against a surface of a wafer to be polished, the method including initiating operation of the wafer polishing apparatus by contacting the surface of the wafer to be polished with the polishing tape, converting a color image of the polishing tape into a corresponding output signal by a color image sensor, comparing the output signal of the color image sensor to previously received color data by a controller to determine whether a color of the color image of the polishing tape is changed, determining a polishing end point of the wafer when the color of the polishing tape detected by the color image sensor is changed, and outputting a stop signal to stop the operation of the wafer polishing apparatus at the polishing end point of the wafer.

Using the polishing tape may include using a substantially transparent tape having a color penetration capability. Converting the color image of the polishing tape may include detecting a color image on the polishing tape triggered by polishing of the wafer, the color image on the polishing tape corresponding to a color of the wafer being polished. Outputting the stop signal may include outputting a visual signal and/or an auditory signal. Converting the color image of the polishing tape by the color image sensor may include detecting color images at predetermined intervals and converting the detected images into output signals, the output signals being stored sequentially in an internal memory of the controller. Comparing the output signal to previously received color data may include comparing each output signal to an output signal previously stored in the internal memory of the controller. Generating the color images and storing thereof may continue until the end point polishing is determined. Determining the polishing end point of the wafer may be performed in real time.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

The above and other features and advantages will become more apparent to those of ordinary skill in the art by describing in detail exemplary embodiments with reference to the attached drawings, in which.

DETAILED DESCRIPTION

Figure 1A:
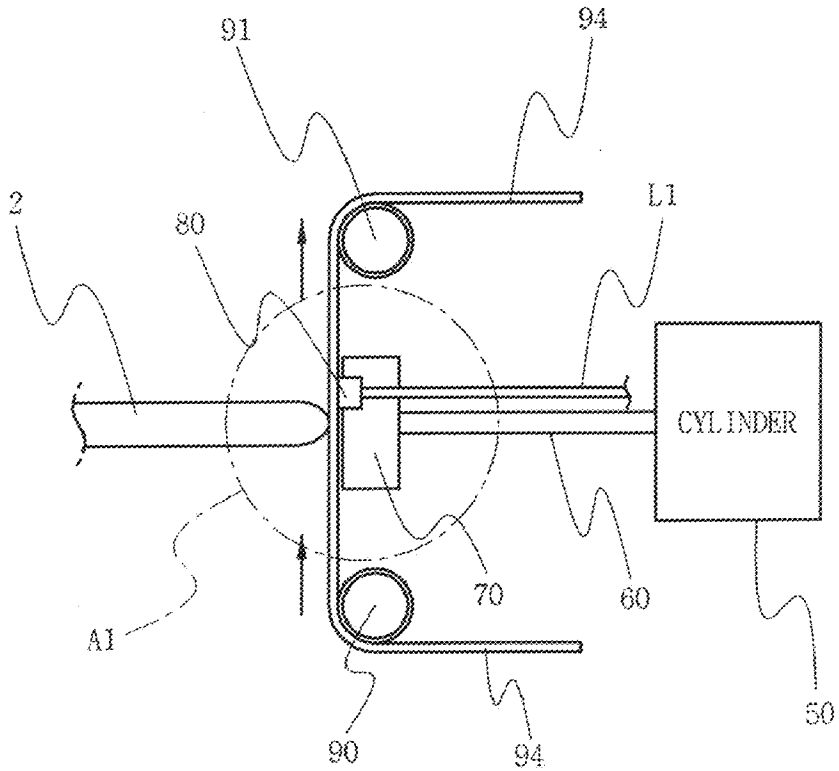
FIG. 1A illustrates a schematic view of a wafer polishing apparatus according to an example embodiment.

Korean Patent Application No. 10-2007-0103367, filed on Oct. 15, 2007, in the Korean Intellectual Property Office, and entitled: "Apparatus for Polishing Wafer Bevel Portion and Method for Detecting Polishing End Point Thereof," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of elements, layers, and regions may be exaggerated for clarity of illustration. It will also be understood that when an element and/or layer is referred to as being "on" another element, layer and/or substrate, it can be directly on the other element, layer, and/or substrate, or intervening elements and/or layers may also be present. Further, it will be understood that the term "on" can indicate solely a vertical arrangement of one element and/or layer with respect to another element and/or layer, and may not indicate a vertical orientation, e.g., a horizontal orientation. In addition, it will also be understood that when an element and/or layer is referred to as being "between" two elements and/or layers, it can be the only element and/or layer between the two elements and/or layers, or one or more intervening elements and/or layers may also be present. Further, it will be understood that when an element and/or layer is referred to as being "connected to" or "coupled to" another element and/or layer, it can be directly connected or coupled to the other element and/or layer, or intervening elements and/or layers may be present. Like reference numerals refer to like elements throughout.

As used herein, the expressions "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" includes the following meanings: A alone; B alone; C alone; both A and B together; both A and C together; both B and C together; and all three of A, B, and C together. Further, these expressions are open-ended, unless expressly designated to the contrary by their combination with the term "consisting of." For example, the expression "at least one of A, B, and C" may also include an nth member, where n is greater than 3, whereas the expression "at least one selected from the group consisting of A, B, and C" does not.

As used herein, the terms "a" and "an" are open terms that may be used in conjunction with singular items or with plural items.

Unless otherwise defined, all terms used herein have the same meaning as commonly understood by one of ordinary skill in the art. It will be further understood that terms used herein should be interpreted as having a meaning that is consistent with their meaning in the context of this specification and the relevant art and will not be interpreted in an idealized or overly formal sense unless expressly so defined herein.

A wafer polishing apparatus according to an example embodiment may include a polishing tape, a color image sensor, and a controller, so an effective detection of a polishing end point of a wafer in real time may be performed. Detection of the polishing end may include, e.g., determination of a point in time when a layer of the wafer to be polished is substantially entirely removed without substantial damage to an underlying layer, i.e., without over etching.

A technological characteristic of the example embodiments is first described in brief as follows. During polishing of the wafer with the polishing tape, a polished layer removed from the wafer may interact with the polishing tape to generate a unique color stain on the polishing tape. Accordingly, the polishing tape may be monitored, so when a colored image of the polishing tape exhibits a predetermined color stain on the polishing tape, an end point of the wafer polishing may be determined in real time. The determination of the end point of the wafer polishing according to an example embodiment exhibits enhanced detection sensitivity, while a requirement for a logical operation processing work in the detection of the polishing end point may be reduced. It is noted that the polishing apparatus according to example embodiments may polish a peripheral portion of the wafer, e.g., an edge area of the wafer, a bevel area of the wafer, and/or a notch area of the wafer. It is noted that an "edge area" refers to peripheral portions of top/bottom surfaces of a wafer along a circumference of the wafer, a "bevel area" refers to a surface connecting top/bottom surfaces of the wafer and angled at an angle other than 0° with respect to the top/bottom surfaces of the wafer, e.g., a curved surface, and a "notch area" refers to an indented portion of a peripheral portion of the wafer along a circumference thereof.

Figure 1B:
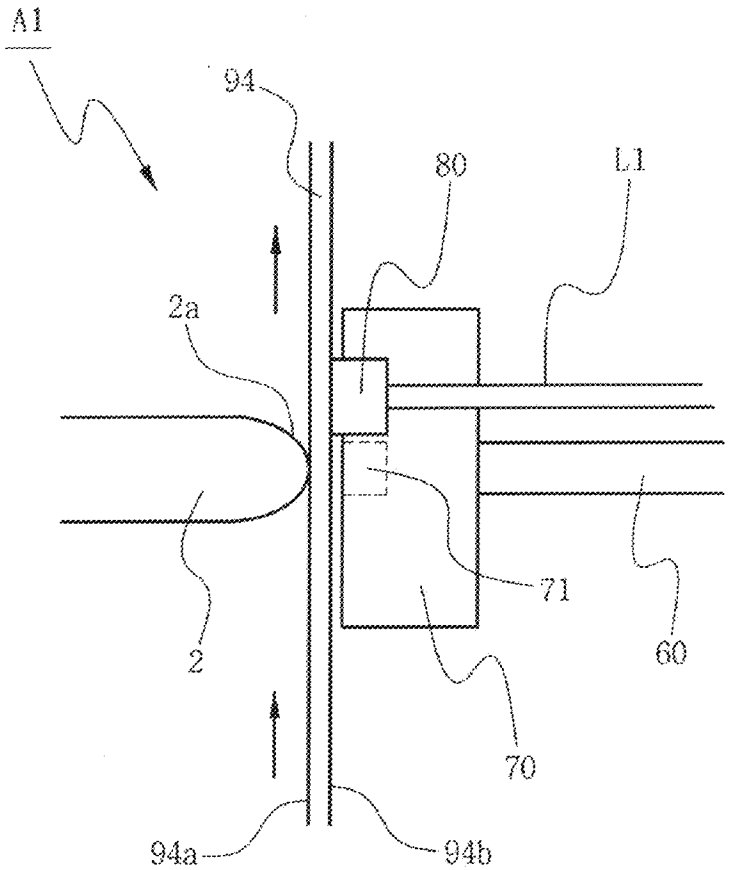
FIG. 1B illustrates an enlarged schematic view of region A1 in FIG. 1A.
Figure 2:
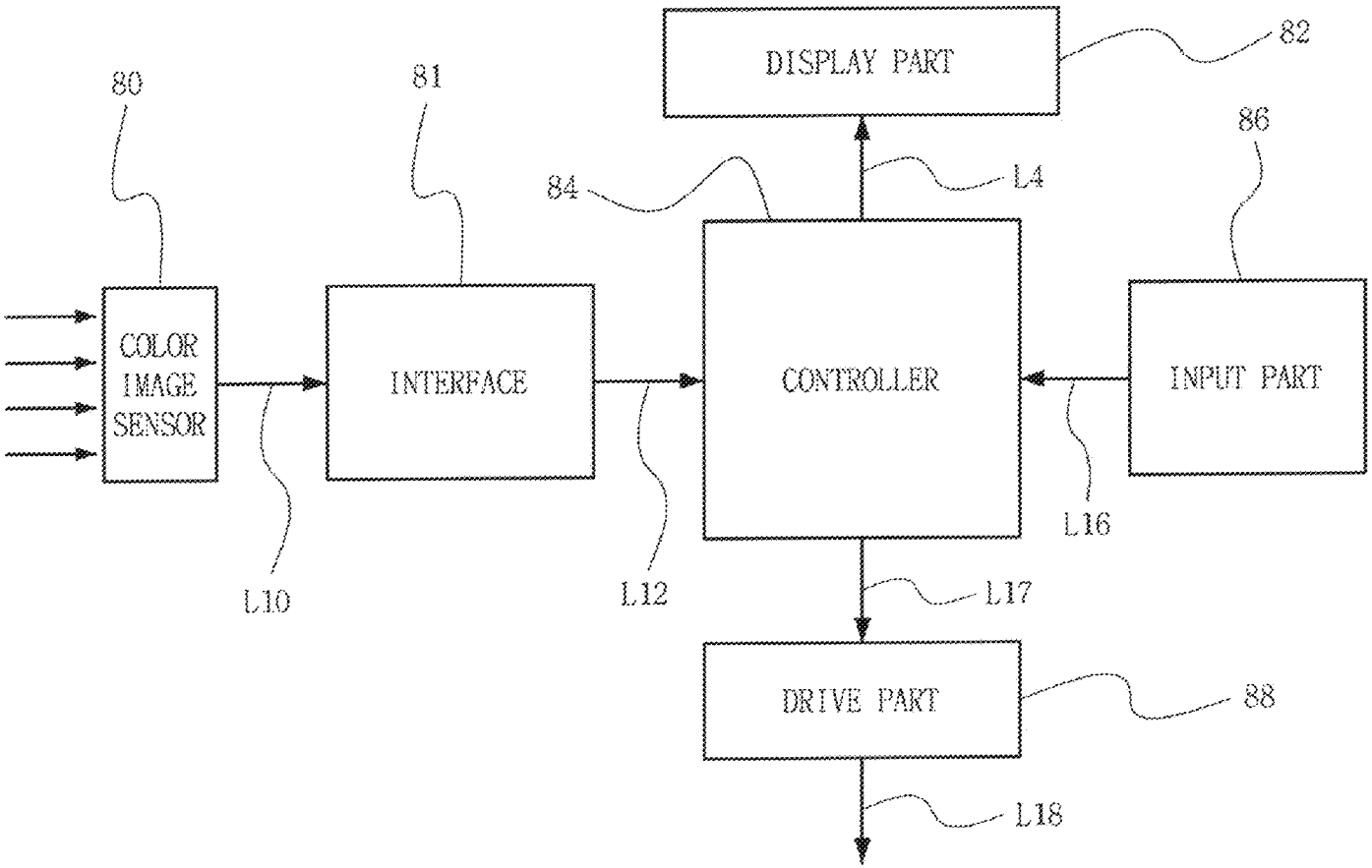
FIG. 2 illustrates a block diagram of an electronic function circuit in the wafer polishing apparatus of FIG. 1A.

A detailed description of the wafer polishing apparatus according to an example embodiment will be described in more detail below with reference to FIGS. 1A-1B. FIG. 1A illustrates a schematic view of a polishing apparatus according to an example embodiment, and FIG. 1B illustrates an enlarged view of circle A1 in FIG. 1A. Referring to FIGS. 1A-1B, a wafer polishing apparatus may include a polishing tape 94, a polishing head 70, and a color image sensor 80. Further, the wafer polishing apparatus may include a controller 84, as illustrated in FIG. 2.

The polishing tape 94 may be a polishing tape having a penetration capability of color image. For example, the polishing tape 94 may be formed of a substantially transparent material having a penetration capability of color image, e.g., one or more of diamond, silica, ceria, alumina, silicon carbide, and so forth. The polishing tape may include a front surface 94*a* and a rear surface 94*b* opposite each other.

As illustrated in FIGS. 1A-1B, the polishing tape 94 may extend along the polishing head 70, and may be guided by first and second guide rollers 90 and 91. In other words, the polishing tape 94 may extend between the first and second guide rollers 90 and 91 at a predetermined tension, so a wafer 2 may contact the front surface 94*a* of the polishing tape 94 in a region corresponding to the polishing head 70. The polishing head 70 may support a pusher pad 71 for pushing the polishing tape 94 against the wafer 2. The pusher pad 71 may be, e.g., positioned inside the polishing head 70, so the polishing head 70 may contact the rear surface 94*b* of the polishing tape 94.

The wafer 2 may be positioned on any suitable support, e.g., a rotary stage, a rotating table supported by a moving arm coupled to a motor, a wafer suction plate, and so forth, so a peripheral portion thereof, e.g., bevel area 2*a* of the wafer 2, may contact the front surface 94*a* of the polishing tape 94. The support of the wafer 2 may be movable according to any axis, e.g., radially clockwise/counterclockwise, vertically up/down, and so forth, and may be mechanically coupled to a spin motor (not shown) to be rotated at a predetermined rate.

The polishing head 70 may include and support the pusher pad 71, and may be coupled to a pushing load 60. The pushing load 60 may be coupled to a piston shaft adapted within a cylinder 50. Accordingly, a motion of the piston shaft within the cylinder 50 may control the pusher pad 71, i.e., pushing of the pusher pad 71 against the polishing tape 94.

The color image sensor 80 may be on the rear surface 94*b* of the polishing tape 94, and may detect a color image of the polishing tape 94. For example, during polishing of the wafer 2, a unique color corresponding to a layer of the polished bevel area 2*a* of the wafer 2 being polished may be stained on the polishing tape 94. The color image sensor 80 may detect the stained color on the polishing tape 94, and may output information, i.e., an output signal, regarding the color stained on the polishing tape 94.

The color image sensor 80 may be any suitable color image sensor, e.g., a charge-coupled device (CCD) with a color filter. The CCD converts light into an electrical signal to detect digital data from a voltage variation based on strength of light. That is, variation of the intensity of light detected by the CCD may generate corresponding voltage variation, so different amounts of charges may facilitate detection of the amount of light. For example, the CCD may be compared to a "film" of a digital camera. That is, light passing through a lens of a digital camera may be incident on the CCD, corresponding to a film in a film camera, so the light incident on the CCD may be converted to an electrical signal, output as analog data, i.e., an image, and converted into digital data through an A/D converter. For example, the CCD may have about 3 million pixels or less, and may have a resolution of about 1600 (width)×1200 (length) pixels. An increase in a size of the CCD may enhance an area thereof that receives light, thereby increasing an amount of information received. A size of the CCD, however, should be controlled to reduce, e.g., manufacturing costs of the CCD.

The color filter in the color image sensor 80 may detect color information, so a combination of the CCD with the color filter may detect both amount of light, e.g., shade of light, and color thereof. The filter in the color image sensor 80 may cover the CCD, e.g., positioned on a front of the CCD, and may be any suitable color filter, e.g., a CMYK color filter, to provide complete color information. The color filter may be selected with respect to usage and type of the color image sensor 80. For example, the color filter may include three color filters of a primary color group, i.e., red (R), green (G) and blue (B), so the color filter may have a dominant reproducibility. In another example, the color filter may include four filters of a complementary color group, i.e., cyan (C), magenta (M), yellow (Y), green (K), so the color filter may have a prominent clearness of image. It is noted that while a three color filter of primary colors may exhibit a dominant reproducibility, it may have lower image clearness and boundary levels as compared to a four color filter of complementary colors. It is further noted that while a four color filter of complementary colors may exhibit prominent image clearness, it may have relatively reduced color sensitivity, e.g., may exhibit image portions having an unclear color.

The output signal of the color image sensor 80 may be transmitted to the controller 84 through an input line L10, as illustrated in FIG. 2. The controller 84 may monitor the color of the polishing tape 94 via the color image sensor 80, and may generate a signal to stop polishing of the wafer 2, i.e., determine an end point of the polishing, when the color of the polishing tape 94 exhibits a predetermined color, e.g., a sufficient color change. For example, the controller 84 may monitor a color image change of the polishing tape 94 with respect to a polishing of layer as determined from an output of the color image sensor 80, and may determine a polishing end point of a polished layer of the wafer 2 in real time. The controller 84 may be, e.g., a microprocessor, a CPU, a digital signal processor, a micro controller, a reduced-command set computer, a complex command set computer, and so forth.

In particular, as illustrated in FIG. 2, the color image sensor 80 may be connected to the controller 84 through an interface 81. The interface 81 may convert information transmitted through the input line L10, i.e., output signal of the color image sensor 80, into data format matching an input format of the controller 84, and may output the data through an output line L12 to the controller 84. It is noted, however, that other configurations of the controller 84 with respect to the color image sensor 80, e.g., the controller 84 and the color image sensor 80 may be directly coupled to each other without the interface 81, are within the scope of the present invention.

As further illustrated in FIG. 2, an input part 86 may be coupled to the controller 84 through a line L16 to provide input information, e.g., manipulation information, from an external source, e.g., an operator. A drive part 88 may be connected to the controller 84 through a line L17 to output a drive on/off control signal for controlling the polishing operation through a line L18. In other words, when a drive-on control is output from the controller 84 to the drive part 88, the polishing operation may be performed, and when a drive-off control signal is output to the drive part 88, the polishing operation may be stopped. The drive part 88 may further include a function of driving an alarm or a speaker. A display part 82, e.g., a liquid crystal monitor, may be connected to the controller 84 via a line L4 to display, e.g., status information related to the polishing operation, output visual alarm information indicating a polishing end point on a screen, and so forth.

Figure 3:
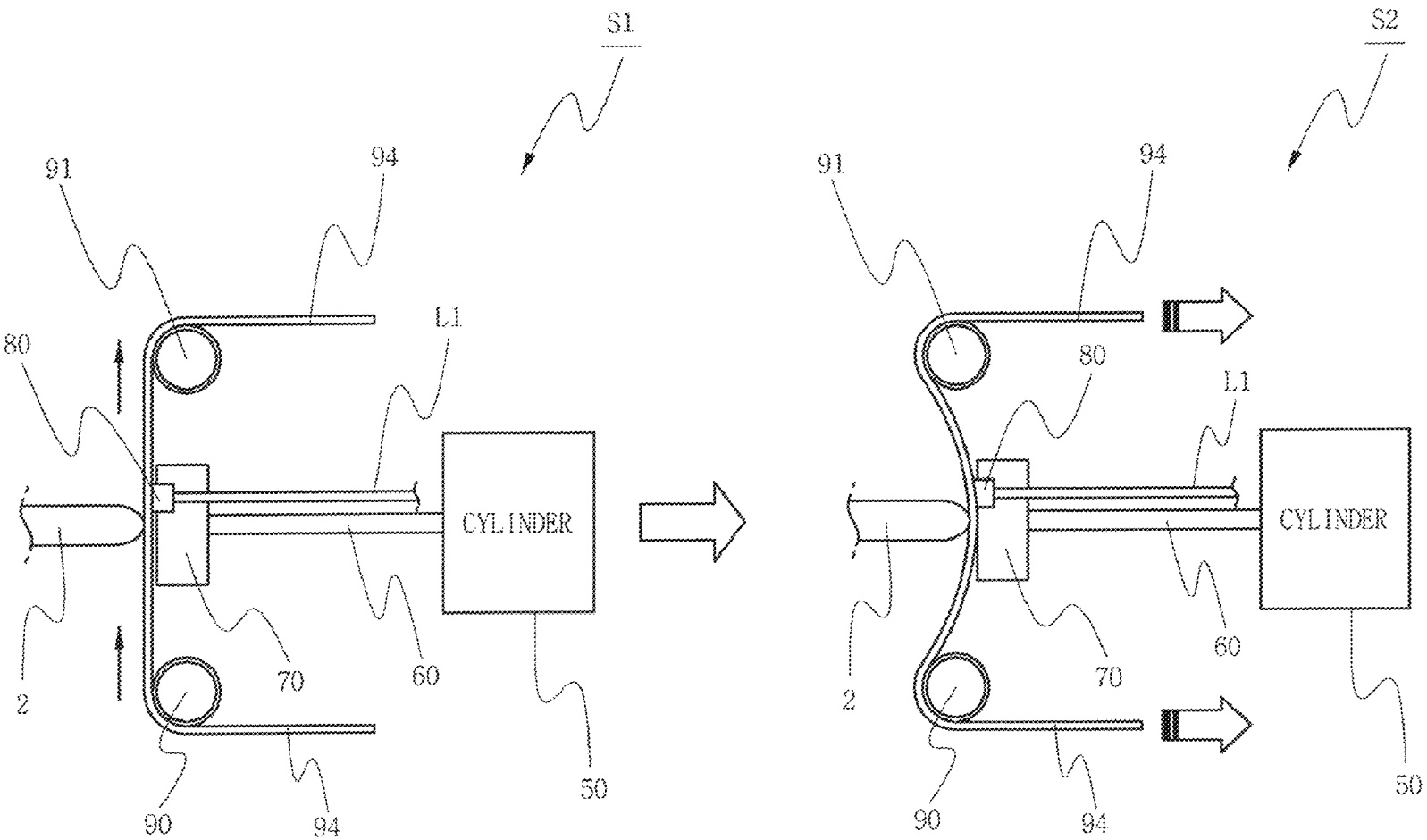
FIG. 3 illustrates states of a polishing tape in the wafer polishing apparatus of FIG. 1A before/after polishing, respectively.
Figure 4:
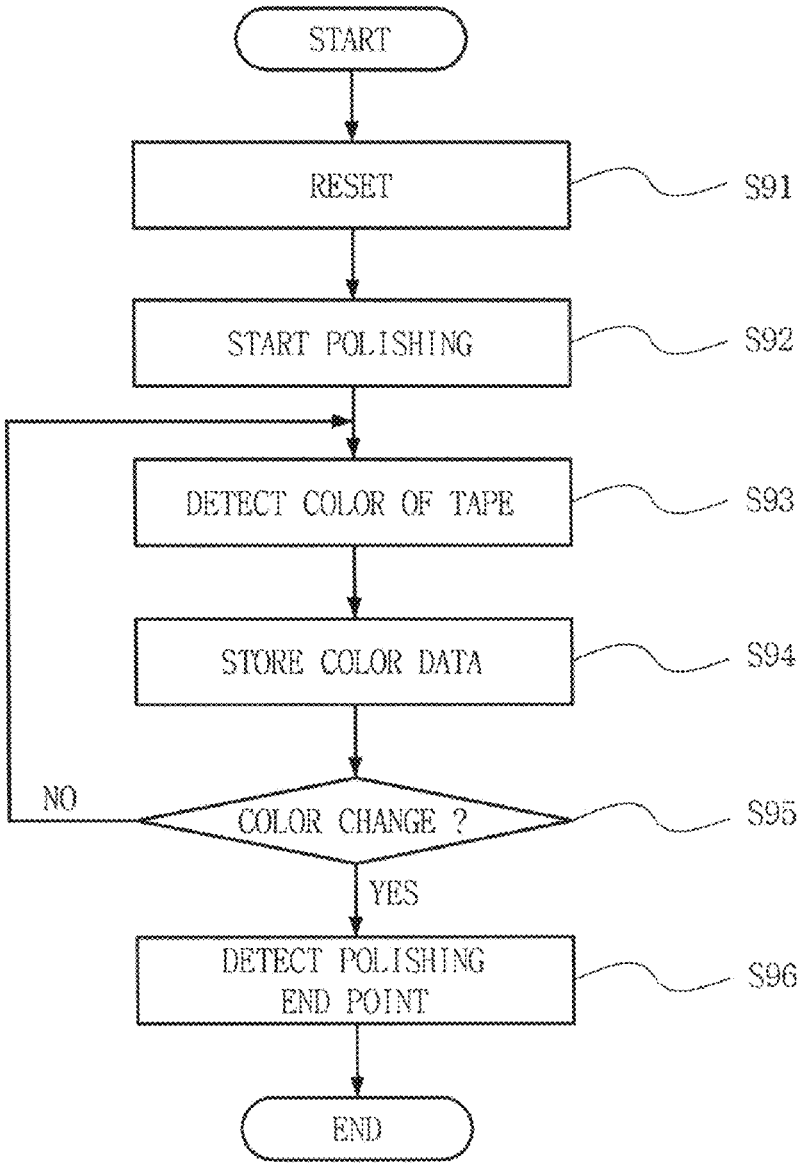
FIG. 4 illustrates a control flowchart for detecting a polishing end point in a wafer polishing apparatus according to an example embodiment.

Operation of the polishing apparatus according to an example embodiment will be described in more detail with reference to FIGS. 3-4. FIG. 3 illustrates tension states of a polishing tape during operation of a polishing apparatus according to an example embodiment, and FIG. 4 illustrates a control flowchart for a polishing end point detection performed by the controller of FIG. 2.

Referring to FIG. 3, a first state S1 indicates a tension state of the polishing tape 94 immediately before a start point of the polishing operation of the polishing apparatus, and a second state S2 indicates a tension state of the polishing tape 94 during the polishing operation. As illustrated in FIG. 3, in the first state S1, the polishing tape 94 may extend between the first and second guide rollers 90 and 91 at a constant tension. When the polishing tape 94 contacts the peripheral portion of the wafer, e.g., a beveled area of the wafer 2, the polishing operation may start, so the polishing tape 94 may move to remove portions, e.g., an external polishing layer from the bevel area 2*a* of the wafer 2 that includes surface roughness, of the wafer 2. As the polishing operation progresses, a unique color, i.e., a color corresponding to the external polishing layer removed from the wafer 2, may stain the polishing tape 94, and may be sensed by the color image sensor 80, e.g., the color image sensor 80 may detect the color developing on the polishing tape 94 continuously or at predetermined intervals. It is noted that even though the polishing operation progresses and a diameter of the wafer 2 may decrease and a tension state of the polishing tape 94 may gradually change and reach the second state S2, an end point of the polishing process according to an example embodiment may be determined according to a color image of the polishing tape 94 as detected by the color image sensor 80 and not via a tension state of the polishing tape 94.

A detailed description of the detection of the end point of the polishing operation will be described with reference to FIG. 4. First, in operation S91, an initialization of an electronic function circuit block of the polishing apparatus may be performed. The initialization may include an operation of resetting a register adapted within the controller 84 or an operation of resetting various flags. The drive part 88 may receive a drive on signal in operation S92 to start the polishing operation, and the color image sensor 80 may begin operation to detect a color image of the polishing tape 94 in operation S93. Information of the color image of the polishing tape 94 detected by the color image sensor 80 may be transmitted to the controller 84, and may be stored as color data in an internal memory of the controller 84 in operation S94. For example, a plurality of output signals from the color image sensor 80 may be stored in the controlled order according to transmittance sequence, i.e., output signals may be stored in the order they were received.

In operation S95, color data detected by the color image sensor may be compared to previously stored color data, so each output signal may be compared to an immediately preceding stored output signal in the controller 84 to determine whether the color of the polishing tape has changed. For example, if no color change is detected, the polishing operation may continue, i.e., operations S93-S95 may repeat until a color change in the polishing tape 94 is detected. If a color change is detected in operation S95, a polishing end point may be determined and the polishing operation may stop. In other words, if a polishing target is not complete, i.e., the polishing apparatus has not reached the polishing end point, the polishing operation may continue because no color change is detected. When the polishing target is complete, the color of the polishing tape 94 changes, thereby indicating the end point of the polishing operation. As soon as a change in the color is detected, a stop signal to stop the polishing operation may be output to the drive part 88, so rotation of a wafer support, e.g., a wafer suction table and movement of the polishing tape 94 may be stopped. The end point of the polishing operation may be indicated by an alarm, e.g., a visual alarm displayed on the display part 82, a sound alarm such as a buzzer may be activated, an alarm may be transmitted to other locations, and so forth. Thus, the polishing end point may be determined in operation S96.

Figure 5A:
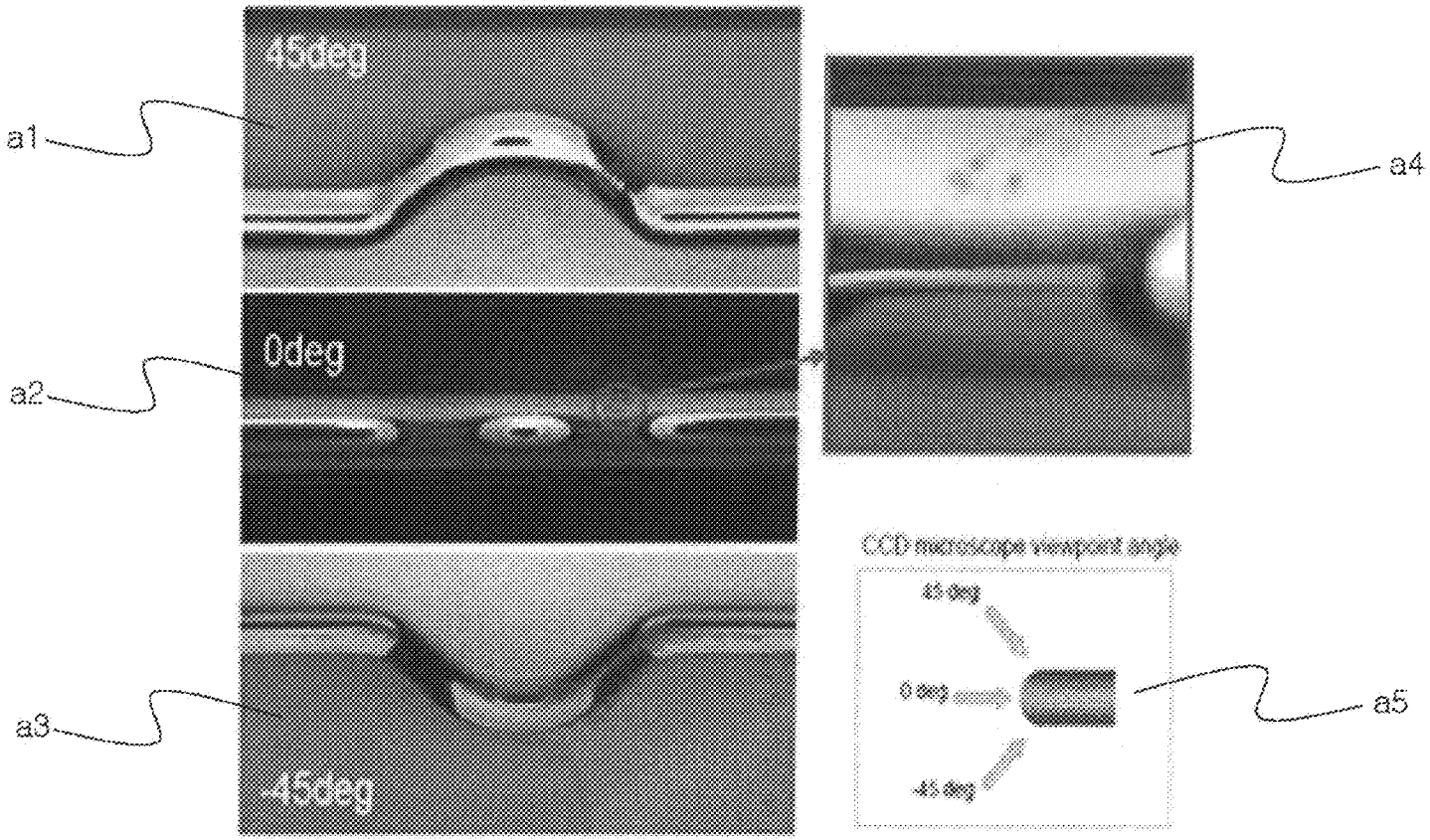
FIG. 5A-5B illustrate photographs of color image changes in a wafer polished according to example embodiments.
Figure 5B:
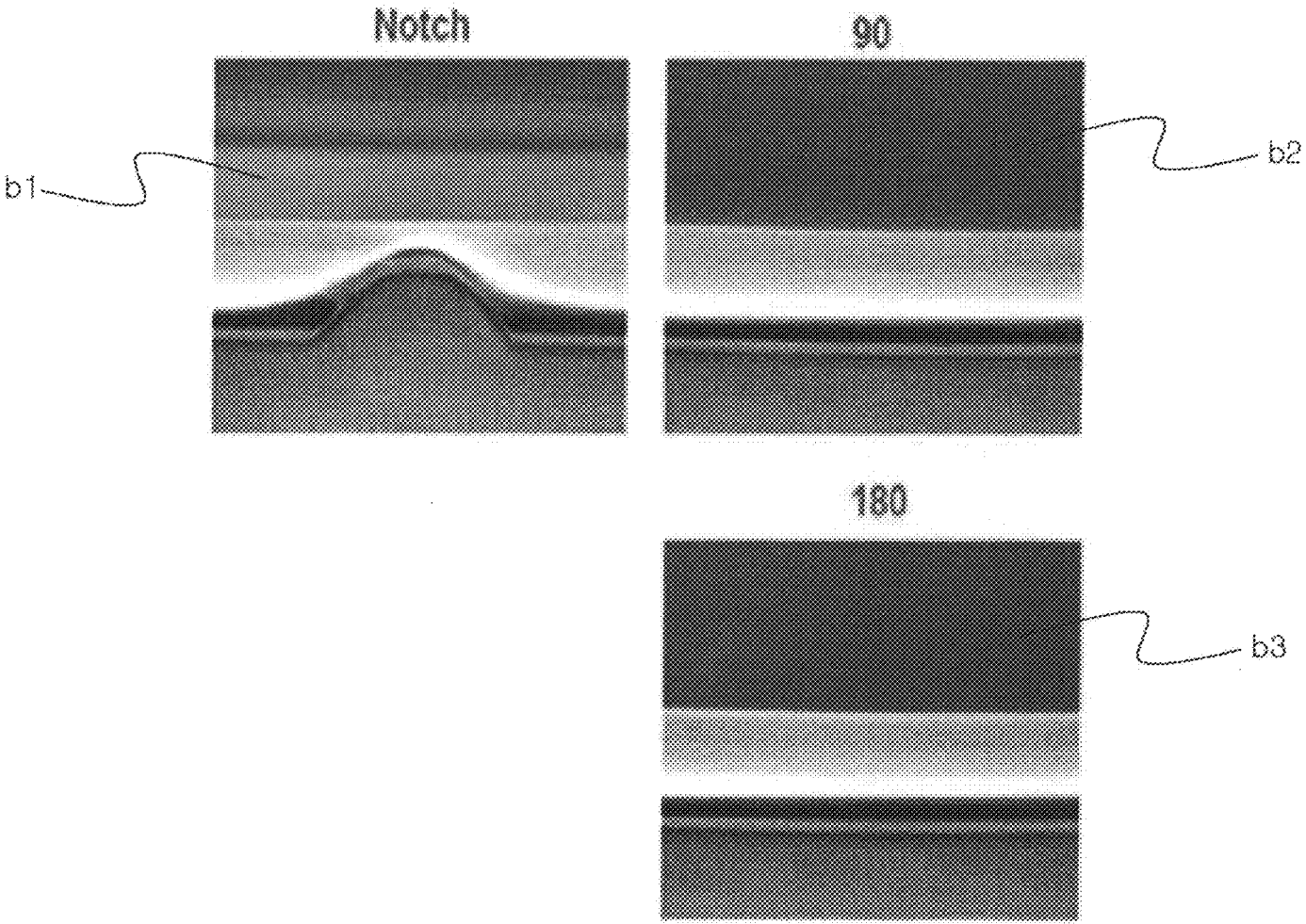

FIGS. 5A-5B illustrate a comparison of color image changes in the wafer 2 after a polishing operation according to an example embodiment. In particular, FIG. 5A illustrates photographs of edges of the wafer 2 before polishing, and FIG. 5B illustrates photographs of edges of the wafer 2 after polishing.

It is noted that in FIG. 5A, a1 denotes a bevel area shown at an angle of 45 degrees to a horizontal face of the wafer 2, a2 denotes a bevel area shown at an angle of 0 degrees to a horizontal face of the wafer 2, and a3 denotes a bevel area shown at an angle of (−45) degrees to a horizontal face of the wafer 2. Further, a4 denotes an enlarged photograph of a2. For clarity, a5 illustrates a schematic representation of the angle viewpoints orientation of a1-a3 with respect to the wafer 2 as detected by a CCD microscope. In FIG. 5B, b1 denotes a notch area, b2 denotes a shape shown at an angle of 90 degrees to a horizontal face of the wafer 2, and b3 denotes a shape shown at an angle of 180 degrees to a horizontal face of the wafer 2, i.e., an edge area of the wafer. As illustrated in FIGS. 5A-5B, defects of notch area or edge or bevel part may be removed by performing polishing on an edge of a wafer, e.g., a bevel portion, according to an example embodiment so excessive polishing may be prevented or substantially minimized, e.g., even a bare silicon layer.

It is noted that a color image detecting method of a polishing tape may be diversely changed without deviating from the scope of the invention. Although example embodiments are described with reference to polishing of an edge of a wafer, any polishing processes, e.g., a general CMP process or other polishing processes, are within the scope of the present invention. According to example embodiment, a detected sensitivity of a polishing end point may be prominent and a burden for a logical operation processing work in the detection of polishing end point may be lessened. Thus, precise detection of a polishing end point of a polished-surface of a wafer may be enhanced.

Example embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A wafer polishing apparatus, comprising:

a polishing tape extending between two guide rollers, the polishing tape being substantially transparent and a first surface of the polishing tape contacting a surface of a wafer to be polished;

a polishing head including a pusher pad, the pusher pad adapted to push the polishing tape against the surface of the wafer to be polished;

a color image sensor adjacent to the polishing tape, the color image sensor being adapted to detect a color image of the polishing tape and to output a signal corresponding to the detected color image, and the color image sensor being on a second surface of the polishing tape, the second surface of the polishing tape being opposite the first surface of the polishing tape; and a controller connected to the color image sensor, the controller being adapted to receive the signal output from the color image sensor and to determine when a color of the color image detected by the color image sensor changes, a change in the color image indicating a polishing end point.

2. The apparatus as claimed in claim 1, wherein the polishing tape exhibits a penetration capability of color image.

3. The apparatus as claimed in claim 1, wherein the polishing tape includes one or more of diamond, silicon carbide, silica, ceria, and alumina.

4. The apparatus as claimed in claim 1 wherein the color image sensor is adapted to detect and to generate the color image of the polishing tape, the color image including a stain formed on the polishing tape, and the stain corresponding to a color of the surface of the wafer to be polished.

5. The apparatus as claimed in claim 1, wherein the surface of the wafer to be polished is a bevel area of the wafer.

6. The apparatus as claimed in claim 1, wherein the surface of the wafer to be polished is a peripheral portion of the wafer.

7. The apparatus as claimed in claim 6, wherein the peripheral portion of the wafer includes at least one of an edge area of the wafer, a bevel area of the wafer, and a notch area of the wafer.

8. The apparatus as claimed in claim 1, wherein the controller is adapted to output a stop signal to stop a polishing of the wafer when the polishing end point is determined.

9. The apparatus as claimed in claim 8, wherein the stop signal includes a visual signal and/or an auditory signal.

10. A method of detecting a polishing end point in a wafer polishing apparatus that includes a polishing tape between two guide rollers and a polishing head, the polishing head including a pusher pad adapted to push the polishing tape against a surface of a wafer to be polished, the method comprising:

contacting the surface of the wafer to be polished with a first surface of the polishing tape, the polishing tape being substantially transparent;

converting a color image of the polishing tape into a corresponding output signal by a color image sensor on a second surface of the polishing tape, the second surface of the polishing tape being opposite the first surface of the polishing tape;

comparing the output signal of the color image sensor to previously received color data by a controller to determine whether a color of the color image of the polishing tape is changed;

determining a polishing end point of the wafer when the color of the polishing tape detected by the color image sensor is changed; and outputting a stop signal to stop the operation of the wafer polishing apparatus at the polishing end point of the wafer.

11. The method as claimed in claim 10, wherein contacting the polishing tape includes using a tape having a color penetration capability.

12. The method as claimed in claim 11, wherein converting the color image of the polishing tape includes detecting a color image on the polishing tape triggered by polishing of the wafer, the color image on the polishing tape corresponding to a color of the wafer being polished.

13. The method as claimed in claim 10, wherein outputting the stop signal includes outputting a visual signal and/or an auditory signal.

14. The method as claimed in claim 10, wherein converting the color image of the polishing tape by the color image sensor includes detecting color images at predetermined intervals and converting the detected images into output signals, the output signals being stored sequentially in an internal memory of the controller.

15. The method as claimed in claim 14, wherein comparing the output signal to previously received color data includes comparing each output signal to an output signal previously stored in the internal memory of the controller.

16. The method as claimed in claim 14, wherein generating the color images and storing thereof continues until the end point polishing is determined.

17. The method as claimed in claim 10, wherein determining the polishing end point of the wafer is performed in real time.

* * * * *